US005086615A

United States Patent [19]

Bodnar

[11] Patent Number: 5,086,615

[45] Date of Patent: Feb. 11, 1992

[54] COATED SPINNING RINGS AND TRAVELERS

[75] Inventor: Michael L. Bodnar, Gastonia, N.C.

[73] Assignee: A. B. Carter, Inc., Gastonia, N.C.

[21] Appl. No.: 480,679

[22] Filed: Feb. 15, 1990

[51] Int. Cl.[5] ..... D01H 7/52; D01H 7/62

[52] U.S. Cl. ..... 57/120; 57/75; 57/119; 57/125

[58] Field of Search ..... 57/75, 119, 120, 125

[56] References Cited

U.S. PATENT DOCUMENTS

| | | | |
|---|---|---|---|
| 1,595,858 | 8/1926 | Crompton | 57/119 |
| 2,448,150 | 8/1948 | Mulholland . | |
| 2,831,313 | 4/1958 | Burns et al. | 57/119 |
| 2,970,425 | 2/1961 | Foard . | |
| 3,084,501 | 4/1963 | Kluttz . | |
| 3,226,924 | 1/1966 | Dalpiaz . | |
| 3,304,707 | 2/1967 | Kluttz . | |
| 3,387,447 | 6/1968 | Trammell et al. . | |
| 3,396,527 | 8/1968 | Joseph, Jr. et al. . | |
| 4,201,066 | 5/1980 | Nolan, Jr. . | |
| 4,666,786 | 5/1987 | Yano et al. . | |
| 4,677,817 | 7/1987 | Kanai | 57/119 X |
| 4,698,958 | 10/1987 | Nakamo et al. | 57/119 |
| 4,868,066 | 9/1989 | Whitmore . | |
| 4,885,905 | 12/1989 | Maruta et al. | 57/119 |

FOREIGN PATENT DOCUMENTS

| | | | |
|---|---|---|---|
| 3333121 | 3/1985 | Fed. Rep. of Germany . | |
| 3836670 | 7/1989 | Japan | 57/119 |

OTHER PUBLICATIONS

"Electroless Nickel/PTFE Composite Coatings" by Dr. Oscar E. Roberto, Udylite, OMI International Corporation, copyright 1989.

"Electroless Nickel/PTFE Composite Coatings" by J. S. Hadley and L. E. Harland, Metal Finishing, Dec. 1987, vol. 85, No. 12.

"Electroless Nickel/PTFE Composites-The Niflor Process" by P. R. Ebdon, International Journal of Vehicle Design, vol. 6, No. 4/5, 1985 (U.K.).

*Primary Examiner*—Daniel P. Stodola
*Assistant Examiner*—William T. Stryjewski
*Attorney, Agent, or Firm*—Dority & Manning

[57] ABSTRACT

Rings and travelers such as for use on spinning frames and the like are provided with the improvement of a coating on the respective surfaces thereof, the coating being chemically deposited onto the surfaces and being uniform in thickness about each surface, the uniform thickness of the coating on each surface ranging from about 0.1 mil to about 0.5 mil, the coating including from about 15% to about 30% by volume of a particulate polymeric fluorocarbon, preferably polytetrafluoro-ethylene, dispersed in a metallic matrix which is preferably a nickel-phosphorus alloy matrix.

7 Claims, 4 Drawing Sheets

COATED SPINNING RINGS AND TRAVELERS

BACKGROUND OF THE INVENTION

The present invention relates generally to improved travelers and rings which are used in textile applications such as spinning rings and travelers for use on spinning frames and more particularly to a chemically deposited coating for travelers and rings providing both hardness and self-lubrication.

In conventional spinning and twisting operations, the limiting factor with respect to increased speeds has always been the wear force between the traveler and the ring. For example, as the textile industry moves to higher spinning speeds, traveler speeds also increase. Further, as spinning speeds increase, tension, the force exerted by the yarn on the traveler, and friction, the force which opposes relative motion between the yarn and the traveler and between the traveler and the ring, increase.

Collateral to the problems of wear resistance are those of lubricity. As the polished surfaces of the traveler wear, they become roughened, increasing the coefficient of friction between the traveler and the ring. Such increased friction results in heat build-up. It is not uncommon for the horns of travelers to burn off, which in addition to loss of production time for replacement of the traveler, can cause damage to the yarn and the ring.

Further, in addition to heat build-up, a roughened traveler will fray and eventually break the yarn, causing lost production time and a low quality end product. And such roughened travelers tend to become loaded with excess fibers resulting from such fraying, or fly, and again decrease production as they must be cleaned or replaced.

Typically, workers in the art have attempted to solve the aforesaid problems by either addressing the requirements of wear resistance or of lubrication. Such one-sided approaches to the present problems have enjoyed some limited success because wear resistance and lubricity are related. In a most general sense, as wear resistance, or hardness, increases such that surface roughening is less, the need for lubrication decreases. Conversely, as lubricity is increased, wear decreases.

U.S. Pat. No. 2,970,425 to Foard is one example of the conventional practice of electrically depositing a metal coating to a surface in order to increase hardness. Foard discloses electroplating spinning rings with a metallic coating having a leveling characteristic such that the outer surface of the coating material does not follow the contours of the surfaces of the ring but, rather, presents a smooth outer surface for traveler contact providing for an initially low coefficient of friction.

Such process, as well as others which provide for the coating by electro-deposition of rings and travelers, represent an improvement over the earlier prior art in that the metallic coating provides a hard surface which is comparatively resistant to wear and is initially smoother than non-coated surfaces. However, such coated surfaces are subject to chipping which raises the coefficient of friction and eventually leads to part failure. Further, such electro-deposited coatings are not deposited onto the part uniformly and produce an improperly balanced ring or traveler.

The problems of non-uniformity of metal coatings are addressed by electroless plating methods such as discussed in U.S. Pat. No. 3,226,924 to Dalpiaz which discloses a method of chemically depositing a metal onto a traveler which results in a uniform coating about the entire surface thereof. However, such chemically deposited metallic coatings also tend to chip.

Also of general interest is U.S. Pat. No. 2,448,150 to Mulholland which discloses providing a spinning ring with a metallic bearing insert. However, a metallic layer, whether applied electrically, chemically or physically, will not provide for as smooth a surface as such layer in combination with a lubricant.

Thus, it is generally known to introduce a lubricant such as oil or the like into a ring and traveler assembly. U.S. Pat. No. 3,304,710 to Kluttz discloses a spinning ring having a lubricant reservoir with means for conducting the lubricant onto the outer wearing surfaces of the ring. However, it is recognized that by such process of wicking oil from a reservoir, a mist of oil is created which produces stains and discolorations on the yarn, resulting in poor end product quality.

Further, oil splattered or spilled on the floor makes the work area unclean and unsafe. Moreover, fine particles of abraded metal from the traveler or ring combine with the lubricating oil and are oxidized thereby. When such oxidized particles contact the yarn, visible, difficult to remove, stains are produced.

In place of an oil-based lubricant, it has ,been known to apply a polymeric coating such as "Teflon" ® to travelers. However, such coating quickly wears off, leaving a bare surface subject to the wear discussed above. An alternative means for providing lubricity to metal ring assemblies is described in U.S. Pat. No. 3,084,501 to Kluttz which, while generally disclosing convoluted surfaces on rings which permit for the free passage of air between the ring and the traveler, refers to the method of impregnating an electropolished metal ring with sulphur to impart lubricity.

An alternative approach to the problems of lubricity has been to provide polymeric, rather than metallic, rings and travelers which inherently provide for a lower coefficient of friction. Plastic travelers have the added advantage of a light weight. It is generally acknowledged that as spinning rates increase, lighter travelers are required. Heretofore, it has been difficult to provide a light weight metal or metal coated traveler for high speed applications.

U.S. Pat. Nos. 3,387,447 to Trammell, et al. and 3,396,527 to Joseph, Jr. et al. disclose rings and travelers, respectively, molded from polyacetal resin which provides for a low coefficient of friction and is essentially self-lubricating such that external lubrication is not required. Both patents further disclose dispersing in the polyacetal resin, prior to molding, particulate fluorocarbon resin to further increase lubricity such that the end product ring or traveler has fluorocarbon particles dispersed throughout.

However, one problem with plastic parts is that they are poor conductors of heat with relatively low softening points. In the case of metal rings and travelers, the heat, which is developed as a result of the friction therebetween, is rapidly conducted away from the traveler. But because of the poor conductability of plastic, heat poses a much greater problem with respect to plastic parts. Trammell et al. address this problem by adding particles of conducting material such as bronze, copper or graphite to the plastic rings of that reference. However, it is generally known that such plastic parts, particularly plastic travelers, are only suitable for use with the heaviest yarns.

Thus, prior art attempts at providing rings and travelers for general spinning use which provide optimum wear resistance and lubricity have met with only limited success. Further, although attempts have been made, no prior art travelers are known which adequately meet the wear resistance and lubricity requirements of high speed spinning and twisting applications.

SUMMARY OF THE INVENTION

Accordingly, it is an object of the present invention to provide a traveler with sufficient wear resistance and lubricity for high speed applications.

It is a further object of the present invention to provide self-lubricating travelers.

It is yet another object of the present invention to provide hard, wear-resistant rings and travelers which have a low coefficient of friction therebetween.

It is a still further object of the present invention to provide a self-lubricating spinning ring which does not require a lubricant reservoir or other means for applying an external lubricant.

It is another object of the present invention to provide rings and travelers for spinning which have a uniform coating deposited thereon which is resistant to chipping.

It is a still further object of the present invention to provide rings and travelers for spinning and twisting having a coating thereon which provides for reduced friction therebetween.

It is a still further object of the present invention to provide rings and travelers for spinning and twisting which preclude staining of the yarn being spun.

These as well as other objects are achieved by providing a self-lubricating traveler such as for use on a spinning ring of a spinning frame, the traveler having an intermediate portion and inturned horns defining a gap therebetween for slidably mounting on a flange of the ring, the ring fixedly mounted to a ring rail and concentrically disposed about a rotating spindle for reciprocating vertically thereabout, with a yarn fed from drafting rolls for threading through the traveler and winding onto the rotating spindle, for tensioning and guiding the yarn onto the rotating spindle, having the improvement of a coating on the surface of the traveler, the coating being chemically deposited thereon and being uniform in thickness about the surface thereof and having a thickness of from about 0.1 mil to about 0.5 mil, the coating including from about 15% to about 30% by volume of a particulate polymeric fluorocarbon uniformly dispersed in a metallic matrix, each fluorocarbon particle being of a size on the order of from about 0.002 mil to about 0.02 mil in diameter.

Generally, the objects may be achieved by providing a traveler having such a chemically deposited coating of uniform thickness thereabout which includes a particulate polymeric fluorocarbon dispersed in a nickel-phosphorus alloy matrix.

Particularly, such a traveler is provided having the improvement of a coating on the surface thereof, the coating being chemically deposited thereon and being uniform in thickness thereabout, the coating including particulate polytetrafluoroethylene uniformly dispersed in a nickel matrix. Preferably, the particulate polytetrafluoroethylene is about 25% by volume of the coating and the nickel matrix is a nickel-phosphorus alloy.

Moreover, the present objects are achieved by providing a ring such as a spinning ring for use on a spinning frame, the ring having at least one flange for slidably supporting a traveler having an intermediate portion and inturned horns defining a gap therebetween for slidably mounting on such flange and for sliding around that flange, the ring having a means for being fixedly mounted to a ring rail and concentrically disposed about a rotating spindle, the ring rail having a means for vertically reciprocating the ring about the spindle in a building motion, with a yarn fed from drafting rolls for threading through the traveler and winding onto the rotating spindle such that the building motion of the ring about the spindle guides the yarn onto the spindle, including the improvement of a coating on the surface of the ring, the coating being chemically deposited thereon and being uniform in thickness about the surface thereof and having a thickness of from about 0.1 mil to about 0.5 mil, the coating including from about 15% to about 30% by volume of a particulate polymeric fluorocarbon uniformly dispersed in a metallic matrix, each fluorocarbon particle being of a size on the order of from about 0.002 mil to about 0.02 mil in diameter.

Generally, the present objects are achieved by providing such a ring having a coating of a particulate polymeric fluorocarbon dispersed in a nickel-phosphorus alloy matrix.

Particularly, a ring is provided with the improvement of a coating on the surface thereof, the coating being chemically deposited thereon and being uniform in thickness about the surface thereof, the coating including particulate polytetrafluoroethylene uniformly dispersed in a nickel matrix. Preferably, the polytetrafluoroethylene is about 25% by volume of the coating and the nickel matrix is a nickel-phosphorus alloy.

Most preferably, the present objects and others are achieved by providing a ring and traveler assembly such as for use on a spinning frame, the ring defining at least one flange for receiving the traveler, the traveler having an intermediate portion and inturned horns defining a gap therebetween by which the traveler is slidably mounted on the flange of the ring for sliding around the flange, the ring having a means for being fixedly mounted to a ring rail and concentrically disposed about a rotating spindle for reciprocating vertically thereabout in a building motion, with a yarn fed from drafting rolls for threading through the traveler and winding onto the rotating spindle such that the traveler tensions and guides the yarn in winding onto the spindle and the building motion of the ring about the spindle guides the yarn onto the spindle, having the improvement of a coating on the respective surfaces of each of the ring and the traveler, the coating being chemically deposited onto each of the surfaces and being uniform in thickness about each surface, the uniform thickness on each surface ranging from about 0.1 mil to about 0.5 mil, the coating including from about 15% to about 30% by volume of a particulate polymeric fluorocarbon uniformly dispersed in a metallic matrix, each fluorocarbon particle being of a size on the order of from about 0.002 mil to about 0.02 mil in diameter.

Generally, the present objects are achieved by providing such a ring and traveler assembly having a coating of a particulate polymeric fluorocarbon dispersed in a nickel matrix.

Particularly, a ring and traveler assembly is provided having a coating on the respective surfaces of each with the coating being chemically deposited onto each of the surfaces and being uniform in thickness about each surface with the coating including particulate polytetrafluoroethylene uniformly dispersed in a nickel matrix. Preferably, the polytetrafluoroethylene is about 25% by volume of the coating and the nickel matrix is a nickel-phosphorus alloy.

One commercially available coating which has proven to be especially suitable for use in the present invention is an electroless nickel/polytetrafluoroethylene (EN/PTFE) composite coating sold by OMI International Corporation of Warren, Mich. as the "EN-LYTE" ® 800/ ENLUBE TM Electroless Nickel Process. It has been found that such coating, when applied to textile rings and travelers in accordance with the present invention, provides a variety of advantages over the prior art because the EN/PTFE composite simultaneously solves the problems of both wear resistance and lubricity inherent in such ring assemblies.

Other chemically deposited nickel coatings having lubricating particles dispersed therein are known, although not with respect to textile parts in general or rings or travelers in particular. Such coatings are also within the scope of the present Invention. U.S. Pat. No. 4,666,786 to Yano et al. discloses a composite nickel plating film which is electrolessly applied and which contains at least one member of wear resistant particles selected from SiC, TiC, WC, $BC_4$, TiN, $Al_2O_3$ or the like and at least one member of lubricating particles selected from BN, $MoS_2$ and Teflon. German Patent DE 3333121 discloses a fluoroplastic, particulate PTFE or polycarbon monofluoride dispersed in a nickel matrix which may be either electrolytically or electrolessly applied.

A still further method of codepositing polytetrafluoroethylene with nickel in an electroless nickel plating process also within the scope of this invention, is discussed in "Electroless Nickel/PTFE Composites—The Niflor Process" by P. R. Ebdon, *International Journal of Vehicle Design*, Vol. 6, Nos. 4–5 (1985), as well as "Niflor—A New Generation Approach to Self Lubricating Surfaces" by P. R. Ebdon, and "Electroless Nickel-PTFE Composite Coatings" by S. S. Tulsi.

Generally, each of the above-discussed coating processes involve chemically plating nickel ions in a bath containing a reducing agent by reducing the ions to metallic nickel. The most common reducing agent employed in such processes is hypophosphite. As components of the reducing agent are necessarily included in the resulting coating, the metallic matrix produced is generally a nickel-phosphorus alloy.

It is known that the hardness of composites having a nickel-phosphorus matrix may be increased by heat treatment. However, for the purposes of the present invention, it has been found that such heat treatment is not preferred, as such increased hardness results in brittle parts, especially in regard to travelers coated in accordance with the present invention. Further, heat treating the rings and travelers alters the lubricating properties of the coating as the PTFE particles are sintered into the metal matrix.

Thus, individual travelers and rings coated according to the present invention demonstrate an increased wear resistance gained from the adequate hardness of the nickel which makes up about 75% by volume and about 85% by weight of the coating. However, as with all relatively moving metallic parts, eventual wear is unavoidable. The present coating provides the advantage of dry self-lubrication which continues with wear. Unlike travelers and rings having a prior art metallic coating, the initially low coefficient of friction for the present rings and travelers does not increase as wear progresses. This is especially true for assemblies of travelers and rings both coated in accordance with the present invention.

However, reduced friction, as evidenced by reduced heat build-up, is also achieved by providing a coated traveler of the present invention on a prior art ring or a prior art traveler on an EN/PTFE coated ring. In the latter case, it has been found that the life of the prior art traveler is notably increased by use on the present ring. Similarly, prior art rings incur less wear when travelers of the present invention are employed in spinning or twisting. Optimum wear resistance and minimum heat build-up are found when both rings and travelers are coated in accordance with the present invention.

Thus, by employing travelers or rings or both of the present invention, end product quality is increased as heat build-up, horn burn-off and fraying by a jagged traveler are all decreased. Also, staining from external lubricants and oxidized abraded metal particles is completely avoided. Production time is maintained at a maximum as travelers last longer such that they require replacement less often. Further, reduced loading resulting from decreased fraying provides for decreased down time.

Moreover, it has unexpectedly been found that when rings and travelers of the present invention are used together, the traveler may be heavier than expected for any given speed. Thus, the problems of providing a lightweight metal-coated traveler for high speed spinning discussed above are completely avoided by the present invention. Consequently, the present rings and travelers allow, not only for a minimization of lost production time, but also for further increased production resulting from higher spinning rates, with improved end product quality.

Other objects, features, and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
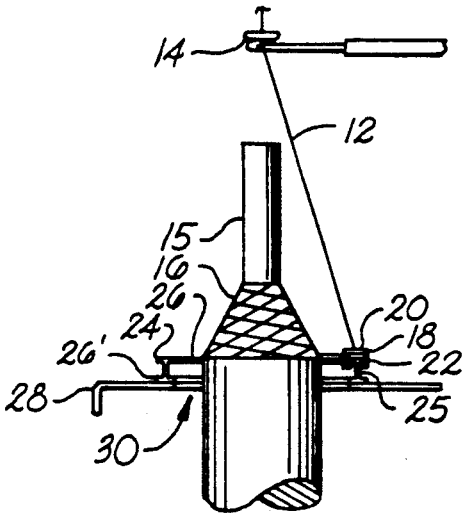
FIG. 1 is a side elevational view of a spinning frame having a spinning ring and traveler in accordance with the present invention.

Repeat use of reference characters in the present specification and drawings is intended to represent same or analogous features or elements of the invention. Features of further embodiments generally analogous to those of the first discussed embodiment will be referenced with like 100 and 200 series numbers.

DETAILED DESCRIPTION

The present invention is directed to rings and travelers for use in textile applications which require the winding of yarn onto a rotating carrier such as spinning, twisting and the like. The invention encompasses both vertical and horizontal rings including reversible and non-reversible (single-flanged) horizontal rings. Similarly, all types of travelers suitable for use on such rings in guiding the yarn onto the rotating carrier are within the scope of the present invention including elliptic, "C" shaped and vertical travelers. Generally, the rotating carrier employed is a bobbin fixedly mounted to a rotating spindle.

Referring more specifically to the drawings, a spinning frame 10 has yarn 12 fed from drafting rolls through guide 14 for winding onto a bobbin 16 which is mounted about and driven by rotating spindle 15. A traveler 18 is elliptic in configuration having an intermediate portion 20 and inturned horns 22 which define a gap therebetween for slidably mounting on a spinning ring 24.

The ring of FIG. 1 includes an intermediate vertical portion 25 and a first flange 26 for supporting the traveler. Ring 24 is reversible, having a second flange 26' which additionally provides a means for mounting the ring to the ring rail 28 such as by a snap fit. The ring rail defines an opening 30 about which the ring is fixedly mounted and which is further concentrically disposed about bobbin 16.

Thus, yarn 12 is fed through guide 14 and threaded through the traveler 18 for winding onto the bobbin. The traveler serves to tension and guide the yarn as it is wound onto the bobbin. The ring rail further provides a vertically reciprocating "builder motion" which further guides the yarn as it is wound onto the bobbin.

Figure 2:
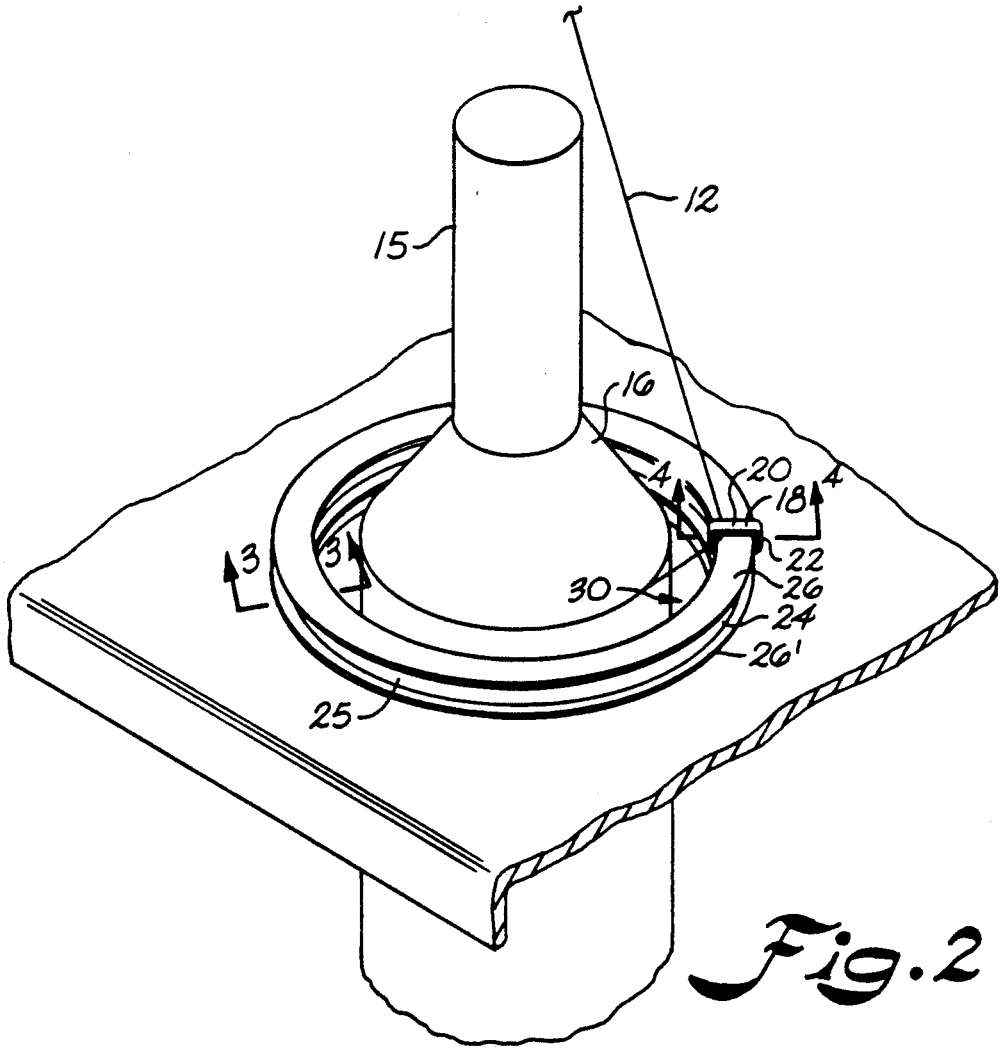
FIG. 2 is a perspective of a spinning ring and traveler in accordance with the present invention having a yarn threaded through the traveler for winding onto a rotating spindle.

The tensioning function of traveler 18 is best illustrated in the close-up perspective view of FIG. 2. Generally, although the traveler slides freely about the flange of the ring. it drags behind the rotation of the spindle such that a tensioning force is imparted to the yarn as it is wound thereabout.

Figure 3:
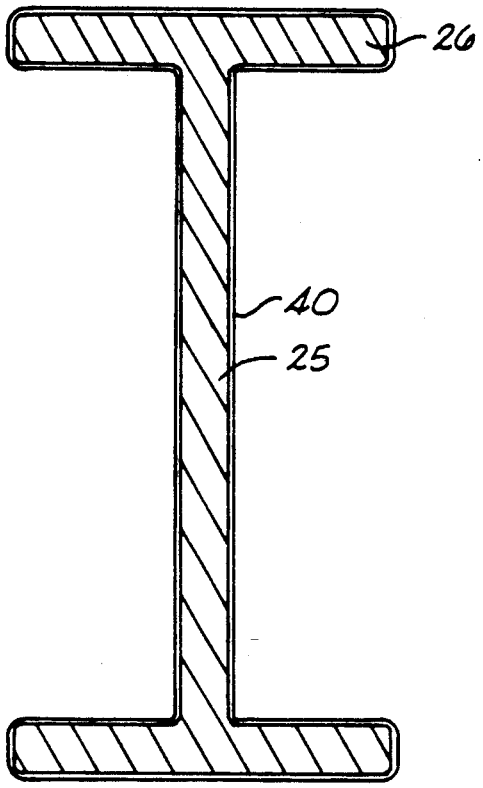
FIG. 3 is a cross-sectional view of the reversible horizontal ring of FIG. 2 taken along the line 3—3.
Figure 4:
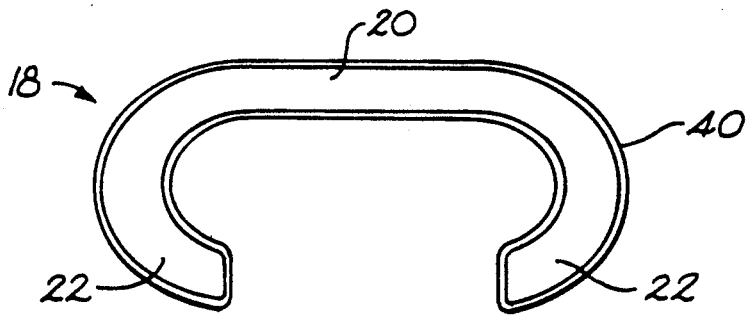
FIG. 4 is a cross-sectional view of an elliptic traveler coated in accordance with the present invention.

Spinning ring 24 and traveler 18 of the present invention are shown in cross-section in FIGS. 3 and 4 taken along the lines 3—3 and 4—4 of FIG. 2, respectively. Each of the ring and traveler has a uniformly deposited coating 40 about the surface thereof. The coating of the present invention is a chemically deposited composite of a fluorocarbon polymer dispersed within a metallic matrix.

The coating preferably has a thickness ranging from 0.1 mil to 0.5 mil (0.0001 inch to 0.0005 inch) such that for a spinning ring 24 which is approximately 0.375 inch from the top surface of flange 26 to the bottom surface of flange 26', it is to be understood that FIG. 3 is not drawn to scale but is presented for illustrative purposes only, with the coating 40 represented at approximately ten times its actual depth with respect to the dimensions of the ring. Similarly, the coating 40 of FIG. 4 is shown at approximately ten times its proportional depth with respect to the dimensions of traveler 18.

Figure 7:
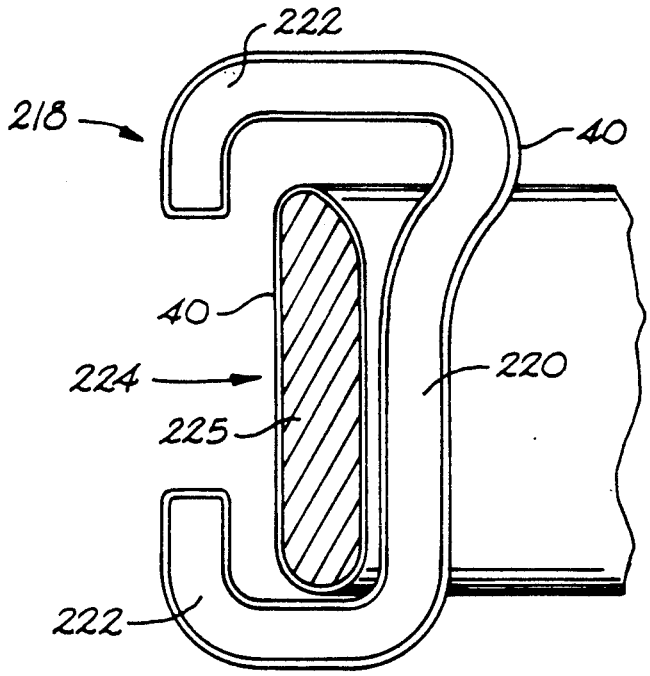
FIG. 7 is a cross-sectional view of a vertical ring having a vertical traveler thereon in accordance with the present invention.
Figure 6:
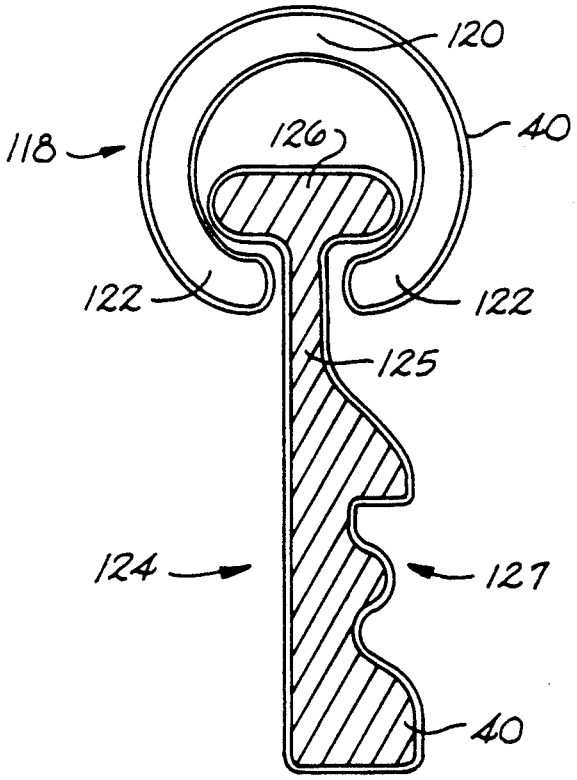
FIG. 6 is a cross-sectional view of a single flanged non-reversible ring having a "C" style traveler thereon in accordance with the present invention.

Also within the scope of the present invention are non-reversible ring 124 and C-shaped traveler 118 as are illustrated in cross-section in FIG. 6 and vertical ring 224 which carries vertical traveler 218 as shown in FIG. 7, all having a coating 40 in accordance with the present invention thereon. "C"-shaped traveler 118 has rounded intermediate portion 120 and inturned horns 122. Non-reversible ring 124 includes an intermediate portion 125, flange 126 and means 127 for mounting to a ring rail. Vertical traveler 218 defines bowed intermediate portion 220 and inturned horns 222. Vertical portion 225 of the vertical traveler defines the flange about which such vertical traveler is carried.

It is to be understood for the purposes of the present invention that C-shaped traveler 118 may be employed on a reversible ring such as that discussed above and that the elliptic traveler of the earlier embodiment may be used with the non-reversible ring 124 of FIG. 6. Further, although the ring and traveler of the present invention are generally discussed in relation to spinning applications throughout, other textile applications, such as twisting which similarly employs a traveler on a ring for winding yarn onto a rotating carrier, are also within the scope of the present invention.

Figure 5:
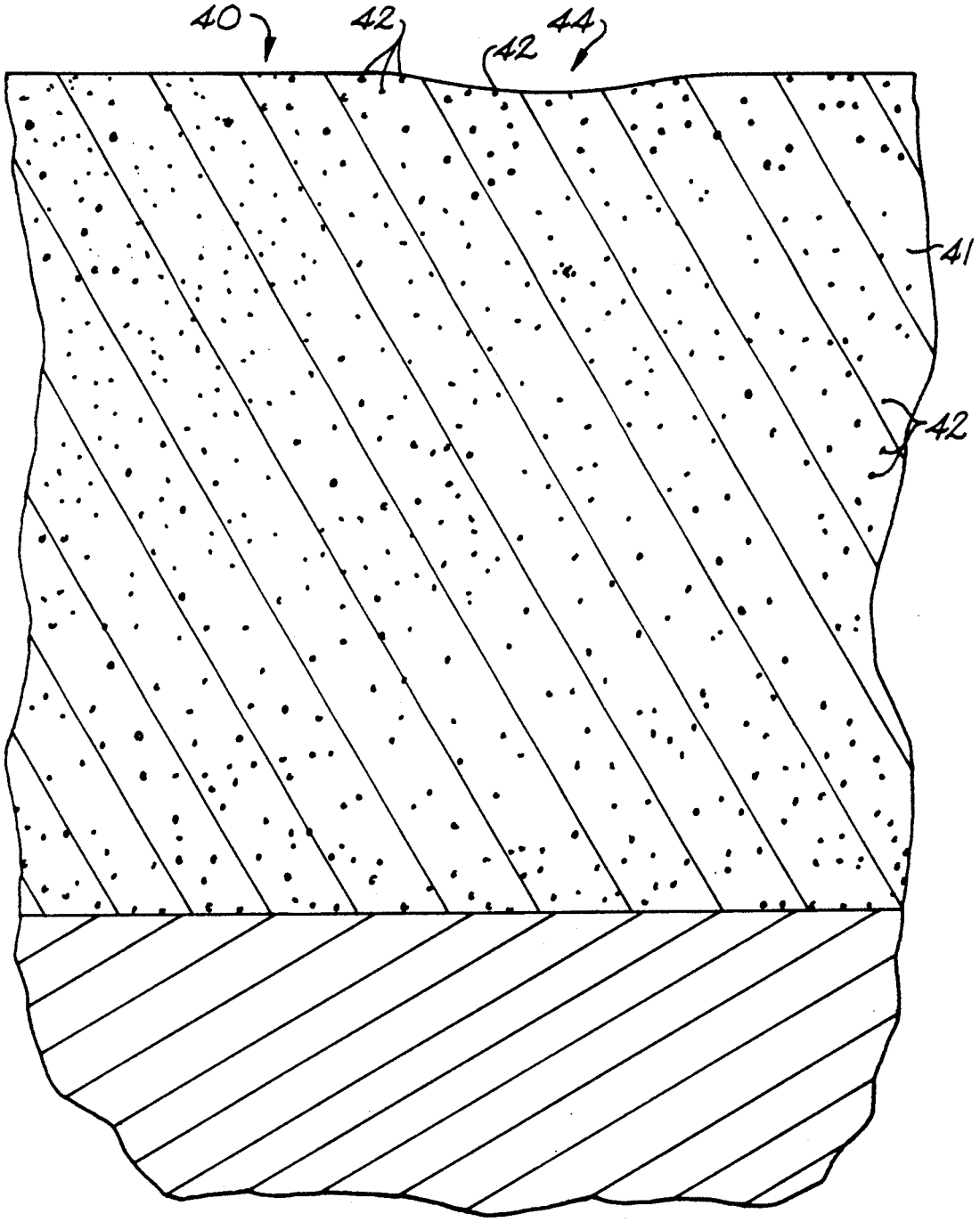
FIG. 5 is a magnified cross-sectional view of the coating of the present invention on a substrate.

Most preferably the coating of the present invention has from about 15% to about 30% by volume of a particulate polymeric fluorocarbon uniformly dispersed in the metallic matrix. Such distribution of fluorocarbon particles is illustrated in FIG. 5 which is an exploded view of coating 40 as deposited on either of the ring or the traveler. Generally, fluorocarbon particles 42, as dispersed in matrix 41, are of submicron dimensions such that they present a surface area on the order of 0.002 mil to 0.02 mil in diameter.

It is noted from FIG. 5 that as depression 44 is formed in the coating, underlying fluorocarbon particles are continuously presented to the opposing wearing surface, which for a traveler is either the ring or the yarn, and for a ring is the traveler. Such polymeric fluorocarbon provides a dry lubricity to the present coating and is preferably polytetrafluoroethylene (PTFE) although other fluorocarbon olefin polymers, such as, for example, the copolymer of tetrafluoroethylene and hexafluoropropylene, are also within the scope of the present invention.

PTFE is preferred, however, because of the exceptionally low coefficient of friction it provides, especially when both the ring and the traveler are coated with a PTFE-containing composite. Such low coefficient of friction is afforded by the smooth structure of the PTFE polymer molecules which permits easy slip of one polymer chain past another.

It is further preferred that the metallic matrix of the present invention is nickel and, most preferably, is a nickel-phosphorus alloy. Such nickel-phosphorus alloy matrix provides hardness and wear resistance. However, the bulk hardness of the present composite coating is lower than that of a conventional nickel-phosphorus coating because of the relative softness of the PTFE polymer particles dispersed therein. Yet, the wear resistance of the present composite coating is greater than that of a conventional nickel-phosphorus coating, presumably because of the reduced friction afforded by the dispersed PTFE particles, especially evident when both the ring and the traveler are coated in accordance with the present invention.

Such reduced friction may account for the unexpectedly high spinning rates achievable when a ring and traveler, both coated in accordance with the present invention, are used in combination. Heretofore, increased spinning rates have required travelers of decreased weight. By the present invention, prior art travelers employed in combination with rings having the present coating must likewise be lighter in weight to allow for increasing spinning speeds. Similarly, travelers of the present invention, when used on prior art rings, must be provided in lighter weights to account for increased spinning speeds. However, it has unexpectedly been found that when rings and travelers, both coated in accordance with the present invention are employed in combination, the traveler may be heavier than expected for any given high spinning speed. Such unexpected property is especially advantageous as the industry moves towards higher and higher spinning rates.

Generally, rings and travelers are coated in accordance with the present invention by submersion in a bath having a nickel ion concentration of from about 5.5 g/L to about 6.5 g/L, a PTFE concentration of from about 3.5 g/L to about 6 g/L and a sodium hypophosphite concentration of from about 27 g/L to about 33 g/L. The latter acts as a reducing agent which reduces the nickel ions, present preferably as nickel sulfate or nickel chloride, to metallic nickel. During precipitation, the bath is subjected to constant agitation to avoid agglomeration of the PTFE particles. Preferred operation conditions are a temperature from about 86° C. to about 89° C. and a pH in the range of from about 4.5 to about 4.8.

The following example illustrates the preparation and application of an electroless nickel/polytetrafluoroethylene coating in accordance with the present invention.

EXAMPLE 1

Travelers were subjected to composite nickel plating in a nickel bath in a high density polypropylene tank in which PTFE particles were dispersed.

| | |
|---|---|
| Bath Composition | |
| Nickel ions | 6.0 g/L |
| Sodium hypophosphite | 30 g/L |
| PTFE | 5.0 g/L |
| Plating Conditions | |
| pH | 4.7 |
| Temperature | 88° C. |
| Agitation | 2 solution turnovers/hour |
| Filtration | continuous, through 100 bags |

The travelers were coated at the rate of approximately 0.25 mil/hour. Analysis of the plated deposits indicated that the coatings comprise approximately 85% by weight of nickel, approximately 6.6% by weight of phosphorus and approximately 8.4% by weight or 25% by volume of PTFE.

These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to be limitative of the invention so further described in such appended claims.

What is claimed is:

1. A self-lubricating traveler for use on a ring in textile applications requiring winding of yarn onto rotating spindle, said ring defining at least one flange for receiving said traveler, said traveler having an intermediate portion and inturned horns defining a gap therebetween for slidably mounting on one of said flanges of said ring, and for sliding around said flange, said ring fixedly mounted to a ring rail and concentrically disposed about a rotating spindle having a bobbin mounted thereon for reciprocating vertically thereabout, with a yarn fed from drafting rolls for threading through said traveler and winding onto said bobbin, for tensioning and guiding said yarn onto said bobbin, the improvement comprising:

a coating on the surface of said traveler, said coating being chemically deposited thereon and being uniform in thickness about the surface thereof and having a thickness of from about 0.1 mil to about 0.5 mil, said coating including from about 15% to about 30% by volume of a particulate polytetrofluoroethylene uniformly dispersed in a metallic matrix including a nickel-phosphorus alloy, each fluorocarbon particle being of a size on the order of from about 0.002 mil to about 0.02 mil.

2. A self-lubricating traveler for use on a ring in textile applications requiring winding of yarn onto a rotating spindle, said ring defining at least one flange for receiving said traveler, said traveler having an intermediate portion and inturned horns defining a gap therebetween for slidably mounting on one of said flanges of said ring, and for sliding around said flange, said ring fixedly mounted to a ring rail and concentrically disposed about a rotating spindle having a bobbin mounted thereon for reciprocating vertically thereabout, with a yarn fed from drafting rolls for threading through said traveler and winding onto said bobbin, for tensioning and guiding said yarn onto said bobbin, the improvement comprising:

a coating on the surface of said traveler, said coating being chemically deposited thereon and being uniform in thickness on the surface thereof, said coating including particulate polytetrafluoroethylene uniformly dispersed in a matrix of nickel-phosphorus alloy.

3. An improved traveler in accordance with claim 2, wherein said particulate polytetrafluoroethylene comprises about 25% by volume of said coating.

4. A ring for use in textile applications requiring winding of yarn onto a rotating spindle, said ring having at least one flange for slidably supporting a traveler, said traveler having an intermediate portion and inturned horns defining a gap therebetween for slidably mounting on one of said flanges and for sliding around said flange, said ring having a means for being fixedly mounted to a ring rail and concentrically disposed about a rotating spindle, said rotating spindle having a bobbin mounted thereon, said ring rail having a means for vertically reciprocating said ring about said spindle with said bobbin thereon in a building motion, with a yarn fed from drafting rolls for threading through said traveler and winding onto said bobbin such that said building motion of said ring about said spindle guides said yarn onto said bobbin, the improvement comprising:

a coating on the surface of said ring, said coating being chemically deposited thereon and being uniform in thickness about the surface thereof, said coating including particulate polytetrafluoroethylene uniformly dispersed in a nickel matrix.

5. An improved ring in accordance with claim 4 wherein said particulate polytetrafluoroethylene comprises about 25% by volume of said coating.

6. A ring and traveler assembly for use in textile applications requiring winding of yarn onto a rotating spindle, said ring defining at least one flange for receiving said traveler, said traveler having an intermediate portion and inturned horns defining a gap therebetween by which said traveler is slidably mounted on one of said flanges of said ring for sliding around said flange, said ring having a means for being fixedly mounted to a ring rail and concentrically disposed about a rotating spindle for reciprocating vertically thereabout in a building motion, said spindle having a bobbin mounted thereon, with a yarn fed from drafting rolls for threading through said traveler and winding onto said bobbin such that said traveler tensions and guides said yarn in winding onto said bobbin and said building motion of said ring about said spindles guides said yarn onto said bobbin, the improvement comprising:

a coating on the respective surfaces of each of said ring and said traveler, said coating being chemically deposited onto each of said surfaces and being uniform in thickness about each surface, said uniform thickness on each surface ranging from about 0.1 mil to about 0.5 mil, said coating including from about 15% to about 30% by volume of a particulate polytetrafluoroethylene uniformly dispersed in a metallic matrix including a nickel-phosphorus alloy, each polytetrafluoroethylene particle being of a size on the order of from about 0.002 mil to about 0.02 mil.

7. A ring and traveler assembly for use in textile applications requiring winding of yarn onto a rotating spindle, said ring defining at least one flange for receiving said traveler, said traveler having an intermediate portion and inturned horns defining a gap therebetween by which said traveler is slidably mounted on one of said flanges of said ring for sliding around said flange, said ring having a means for being fixedly mounted to a ring rail and concentrically disposed about a rotating spindle for reciprocating vertically thereabout in a building motion, said spindle having a bobbin mounted thereon, with a yarn fed from drafting rolls for threading through said traveler and winding onto said bobbin such that said traveler tensions and guides said yarn in winding onto said bobbin and said building motion of said ring about said spindles guides said yarn onto said bobbin, the improvement comprising:

a coating on the respective surfaces of each of said ring and said traveler, said coating being chemically deposited onto each of said surfaces and being uniform in thickness about each surface, said coating including particulate polytetrafluoroethylene uniformly dispersed in a matrix including nickel-phosphorus alloy.

* * * * *